US008777665B2

(12) United States Patent
Il

(10) Patent No.: US 8,777,665 B2
(45) Date of Patent: Jul. 15, 2014

(54) SHIELDED CONNECTOR

(75) Inventor: Ryosuke Il, Susono (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 20 days.

(21) Appl. No.: 13/553,233

(22) Filed: Jul. 19, 2012

(65) Prior Publication Data

US 2013/0023155 A1 Jan. 24, 2013

(30) Foreign Application Priority Data

Jul. 19, 2011 (JP) ..... 2011-158290

(51) Int. Cl.
*H01R 13/658* (2011.01)

(52) U.S. Cl.
USPC ..... 439/607.27; 439/660

(58) Field of Classification Search
USPC ..... 439/607.01, 607.24, 607.27, 607.47, 439/607.48, 607.53, 607.55, 660
See application file for complete search history.

(56) References Cited

U.S. PATENT DOCUMENTS

| | | | | |
|---|---|---|---|---|
| 5,421,744 | A | 6/1995 | Hio | |
| 6,039,606 | A * | 3/2000 | Chiou | 439/607.45 |
| 6,165,016 | A * | 12/2000 | Lai | 439/607.41 |
| 6,280,252 | B1 * | 8/2001 | Huang | 439/607.48 |
| 6,390,852 | B1 * | 5/2002 | Wang | 439/607.48 |
| 6,599,151 | B2 | 7/2003 | Chiran et al. | |
| 6,659,801 | B2 * | 12/2003 | Nishio et al. | 439/607.48 |
| 6,783,397 | B2 * | 8/2004 | Yang Lee | 439/607.45 |
| 7,690,948 | B2 * | 4/2010 | Lung | 439/607.27 |
| 7,833,058 | B2 * | 11/2010 | Zhang et al. | 439/607.41 |
| 2001/0046809 | A1 | 11/2001 | Chiran et al. | |
| 2002/0155757 | A1 | 10/2002 | Yoshioka | |

FOREIGN PATENT DOCUMENTS

| | | |
|---|---|---|
| CN | 2711949 Y | 7/2005 |
| JP | 06-223909 | 8/1994 |
| JP | 2001-332356 | 11/2001 |

OTHER PUBLICATIONS

Office Action issued in corresponding China Application No. 201210248782.1 mailed May 15, 2014.

* cited by examiner

*Primary Examiner* — Thanh Tam Le
(74) *Attorney, Agent, or Firm* — Banner & Witcoff, Ltd.

(57) ABSTRACT

A shielded connector includes an inner housing to which terminals connected to a shielded electric wire is attached, a shield shell that includes a shield part and a barrel part, and a shield shell cover that covers a shielded wire exposure part of the shielded electric wire. The shield shell cover has a pair of insertion lap parts which are inserted between two side surfaces of the inner housing and two side surfaces of the shield part. A backlash preventing unit is provided on a top surface and a bottom surface of the inner housing and parts of the shield part which opposite to the top surface and the bottom surface of the inner housing so as to prevent a shaking between the inner housing and the shield shell.

2 Claims, 5 Drawing Sheets

SHIELDED CONNECTOR

BACKGROUND

The present disclosure relates to a shielded connector.

A shielded connector is known which is connected to a multi-stranded shielded cable which has a plurality of signal lines in which conductors in which a plurality of wires are twisted are covered with insulative sheath layers (for example, refer to JP-A-6-223909 and JP-A-2001-332356).

For example, a shielded connector disclosed in JP-A-2001-332356 includes a plurality of terminals which are connected to signal lines which are exposed at the end of a shielded cable, an insulator body (inner housing) which accommodates and holds these terminals, a shielding metal cover (a shield shell and a shield shell cover) which covers the outside of the insulator body and all the exposed parts of the electric wire connecting parts of the terminals and the signal lines, and an insulative cover housing (outer housing) which is attached to the outside of the shielding metal cover.

The above shielding metal cover has, for example, a pair of U-shaped cover bodies which are engaged with each other. A barrel part (caulking part) which caulks and clamps the shielding layer of the shielded cable is adjacently provided at the back end of one of the U-shaped cover bodies (shield shell). The insulator body into which the terminals connected to the signal lines are accommodated and held is attached to one of the U-shaped cover bodies, and after the shielding layer of the shielded cable is caulked and clamped by the barrel part, two side plates of the other U-shaped cover body (shield shell cover) are assembled by being piled up from the outside of two side plates of the one of the U-shaped cover bodies to form the shielding rectangular pipe-like body.

That is, after the shielding layer of the shielded cable is caulked and clamped by the barrel part of the shield shell, the exposed parts of the signal lines near the caulking part are covered by the shield shell cover, so that all of the exposed parts of the electric wire connecting parts of the terminals which are accommodated and held in the inner housing and the signal lines can be covered by the shielding metal cover, and a shielded connector having a good shielding performance can be obtained.

When the shielded connector is downsized, it is highly desired to control the size of the shielding metal cover. Therefore, the two side plates of the shield shell cover which are assembled by being piled up from the outside of the two side plates of the shield shell are desirable to be assembled by being piled up from the inside of the two side plates of the shield shell. Thus, it is necessary to reduce the width of the inner housing to be smaller than the interval between the two side plates of the shield shell to a degree that the two side plates of the shield shell cover can enter.

However, if the inner housing is smaller than the shield shell to a degree of the two side plates of the shield shell cover, when the shielding layer of the shielded cable is caulked with the barrel part before the shield shell cover is attached, the inner housing might produce a shake inside the shield shell. If a shake of the inner housing occurs at the time of the caulking operation, the precision of the caulking may be reduced.

SUMMARY

The present disclosure is made in view of the above situation, and the object of the invention is to provide a shielded connector which can be downsized by controlling the shake of an inner housing when a shielded electric wire is caulked to a shield shell.

The above object of the present disclosure is achieved with the following structures.

(1) There is provided a shielded connector comprising:

an inner housing to which terminals connected to a shielded electric wire is attached;

a shield shell that includes a shield part which covers the inner housing and a barrel part which fixes a sheath part of the shielded electric wire; and a shield shell cover that covers a shielded wire exposure part of the shielded electric wire which is attached to the shield shell, wherein the shield shell cover has a pair of insertion lap parts which are inserted between two side surfaces of the inner housing and two side surfaces of the shield part which opposite to the two side surfaces of the inner housing; and wherein a backlash preventing unit is provided on a top surface and a bottom surface of the inner housing and parts of the shield part which opposite to the top surface and the bottom surface of the inner housing so as to prevent a shaking between the inner housing and the shield shell.

According to the shielded connector of the structure of the above (1), the inner housing is formed to be smaller than the shield shell by a degree that the insertion lap parts of the shield shell cover can be inserted to the outside of the two side surfaces of the inner housing. That is, the gaps for the insertion lap parts are formed between the two side surfaces of the inner housing and the two side surfaces of the shell. When the terminals are attached to the inner housing, the shielded electric wire is derived from the inner housing. The sheath part of the shielded electric wire is caulked and fixed to the barrel part of the shield shell to which the inner housing is attached. In this case, the above gaps are formed between the inner housing and the shield shell, but the backlash preventing unit is provided between the top and bottom surfaces of the inner housing and the shield part of the shield shell, and the inner housing will not produce a shake inside the shield shell in the widthwise direction. Thereby, a highly precise caulking can be performed, and it is possible to downsize the shielded connector by inserting the insertion lap parts to the inside of the shield shell.

(2) For example, the backlash preventing unit includes a retaining projection which is provided on the top surface of the inner housing, and a retaining recess which is formed at an edge of the shield part and holds the retaining projection in the widthwise direction of the retaining recess.

According to the shielded connector of the structure of the above (2), with the simple structure in which the retaining projection of the inner housing is locked to the retaining recess of the shield part, a shake of the inner housing can be controlled.

According to the shielded connector of the present disclosure, when the shielded electric wire is fixed with the barrel part of the shield shell, the shake of the inner housing inside the shield shell can be controlled. As a result, the inner housing can be smaller than the shield shell to a degree that the insertion lap parts of the shield shell can enter, and the shield shell can be downsized.

The present disclosure has been briefly described above. Further, details of the invention will become more apparent after embodiments of the invention described below (hereinafter referred to as "embodiments") are read with reference to the accompanying figures.

BRIEF DESCRIPTION OF THE DRAWINGS

The above objects and advantages of the present disclosure will become more apparent by describing in detail preferred exemplary embodiments thereof with reference to the accompanying drawings, wherein.

DETAILED DESCRIPTION OF EXEMPLARY EMBODIMENTS

Below, a shielded connector according to an embodiment of the invention is explained with reference to the figures.

A shielded connector 11 according to the present embodiment can be preferably used as a shielded connector at the cable side of USB 2.0 (differential connector for high speed transmission).

Figure 1:
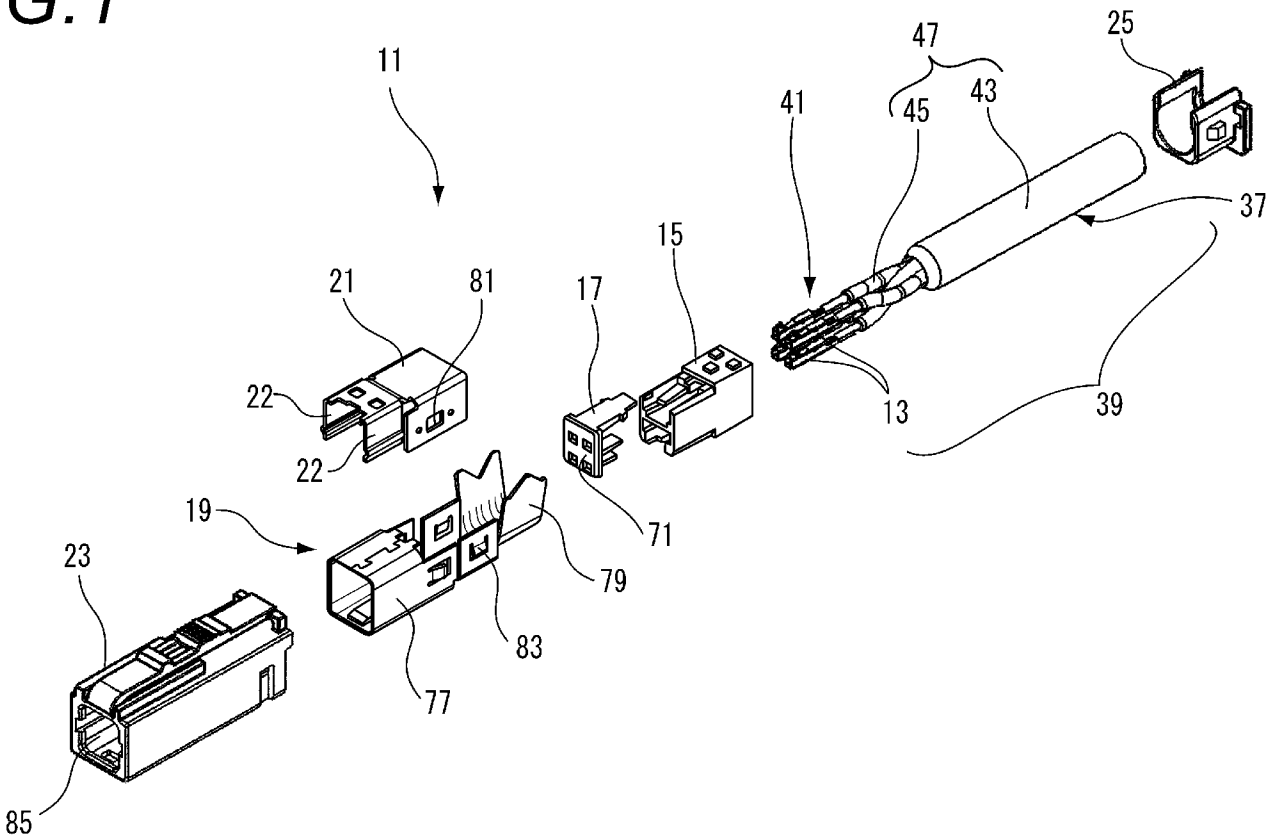
FIG. 1 is an exploded perspective view of a shielded connector according to one embodiment of the present disclosure.

As shown in FIG. 1, the shielded connector 11 includes terminals 13, an inner housing 15, a front folder 17, a shield shell 19, a shield shell cover 21, an outer housing 23 and a rear folder 25.

The terminals 13 are molded with sheet metal processing. In this embodiment, each of the terminals 13 is a female terminal which has a box-like electrical contact part 27 shown in FIG. 7. A contact strip 29 is formed inside the electrical contact part 27, and the contact strip 29 contacts with a board-like tab 31 of a mating male terminal shown in FIG. 8B. A terminal bent part 35 which a housing lance 33 to be described below locks is formed at the upper part of the electrical contact part 27. A terminal installing shielded electric wire 39 is formed when the terminals 13 are connected to a shielded electric wire 37.

It is necessary to strip the shielded electric wire 37 of the skin 47 of a sheath part 43 and a shield foil 45 at a connecting region 41 with the terminals 13. Because the part where the skin 47 is striped may cause an impedance mismatch and make the transmission performance worse, it is preferred to make the part where the skin 47 is striped as short as possible.

The inner housing 15 is molded of synthetic resin material. The inner housing 15 includes a plurality of terminal accommodating chambers 49 (refer to FIG. 7) into which the terminals 13, which are crimped to the ends of a plurality of shielded wires of the shielded electric wire 37, are inserted. The terminals 13 are attached by being inserted into the terminal accommodating chambers 49 which are formed in the inner housing 15, respectively. The terminal accommodating chamber 49 communicates with a tab insertion opening 67 which opens in the front of the inner housing 15 shown in FIG. 7. The rear of the terminal accommodating chamber 49 opens at the rear part of the inner housing 15 as a terminal insertion opening 69. A cantilevered beam-like housing lance 33 is provided inside the terminal accommodating chamber 49. The housing lance 33 locks with the terminal bent part 35 of the terminal 13 which is inserted into the terminal accommodating chamber 49 from the rear in the terminal insertion direction so that the terminal 13 is fixed in the terminal accommodating chamber 49 by being regulated from dropping.

Figure 7:
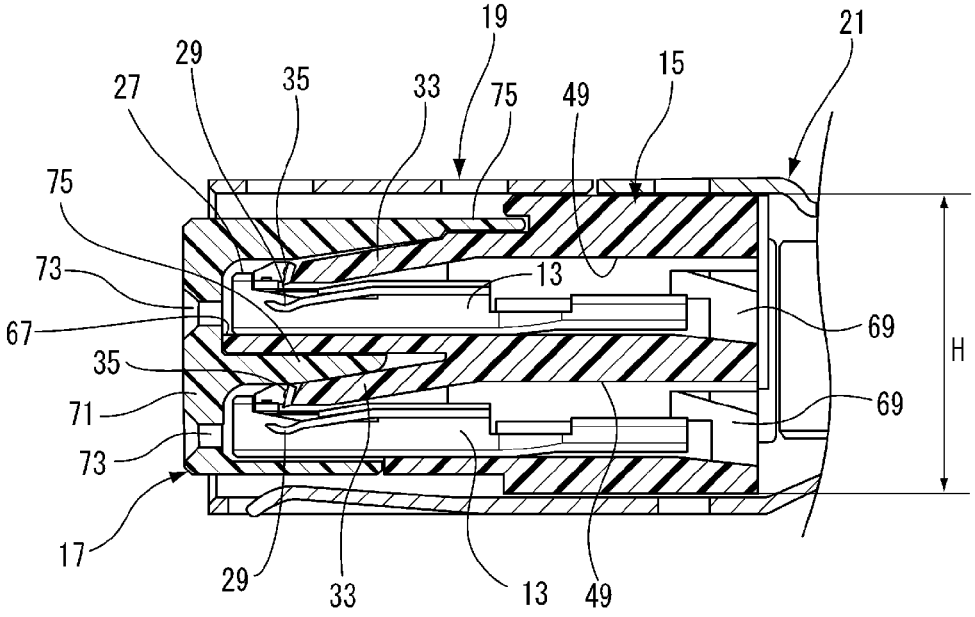
FIG. 7 is a longitudinal sectional view of the shield shell in which the inner housing is accommodated.

The front folder 17 has a front plate 71 shown in FIG. 7, and is attached by being inserted into the front part of the inner housing 15. A plurality of windows 73 corresponding to the tab insertion openings 67 of the inner housing 15 are formed at the front plate 71. A plurality of lance regulating pieces 75 are protruded from the front plate 71, and the lance regulating pieces 75 are inserted into flexible spaces of the housing lances 33. When the lance regulating pieces 75 are inserted into the flexible spaces, the movement of the housing lances 33 in the unlocking direction is regulated, and the terminals 13 are dually locked.

Figure 5:
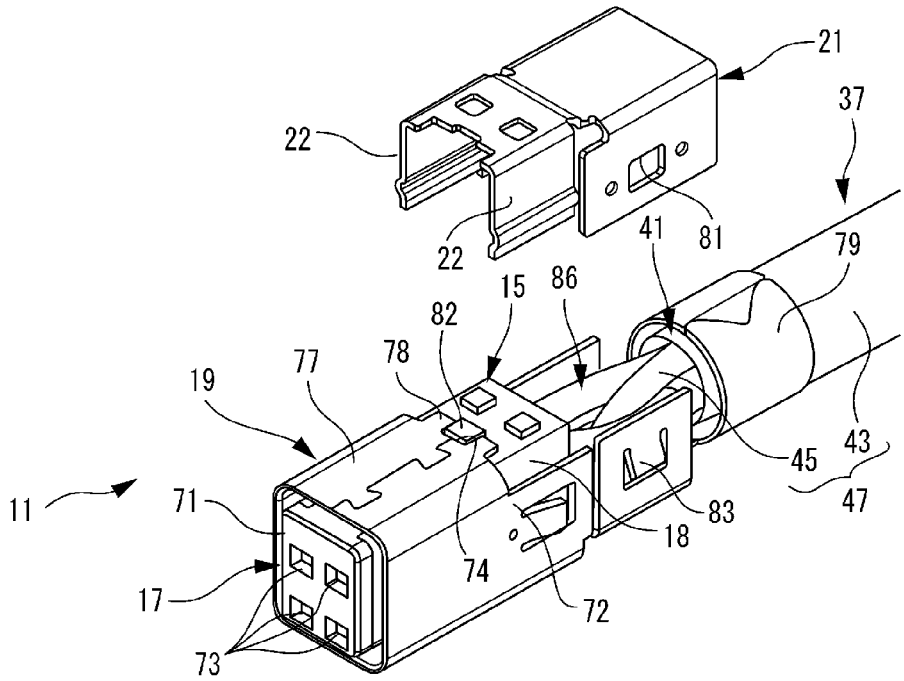
FIG. 5 is a perspective view before a shield shell cover is attached to the shield shell.

The shield shell 19 is formed with sheet metal processing by using sheet metal materials. The shield shell 19 has a rectangular pipe-like shield part 77 which covers the inner housing 15 when the inner housing 15 is inserted inside. Behind the shield part 77, a barrel part 79 which is a crimping part that crimps and fixes the sheath part 43 of the shielded electric wire 37 is adjacently provided. The inner housing 15, into which the terminals 13 of the terminal installing shielded electric wire 39 are attached by being inserted, is inserted into the shield shell 19, and as shown in FIG. 5, the sheath part 43 of the terminal installing shielded electric wire 39 is caulked and fixed to the barrel part 79.

Figure 6:
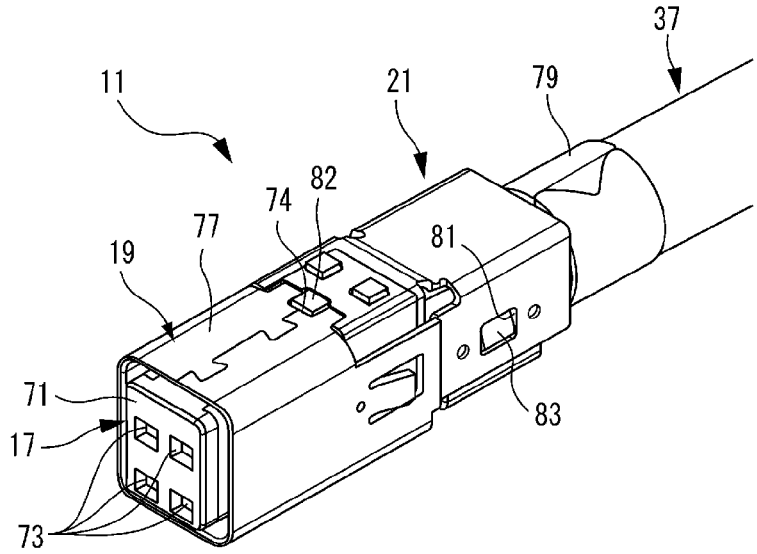
FIG. 6 is a perspective view in which the shield shell cover is attached to the shield shell.

The shield shell cover 21 is attached to the shield shell 19 to cover the shield shell 19 from above. As shown in FIG. 6, the shield shell cover 21 is fixed to the shield part 77 by locking locking holes 81 which are formed at two sides of the shield shell cover 21 to locking claws 83 which are formed at two sides of the shield part 77.

The outer housing 23 is molded of synthetic resin material into a rectangular pipe shape. A shell installing space 85 is formed inside the outer housing 23. The inner housing 15 which is covered by the shield shell 19 is inserted into the shell installing space 85. The rear folder 25 is locked in the shell installing space 85 at the rear part of the outer housing 23 which accommodates the inner housing 15. When the rear folder 25 is locked to the outer housing 23, the inner housing 15 is regulated from dropping, and the shielded electric wire 37 which is derived from the inner housing 15 is supported.

Figure 8A:
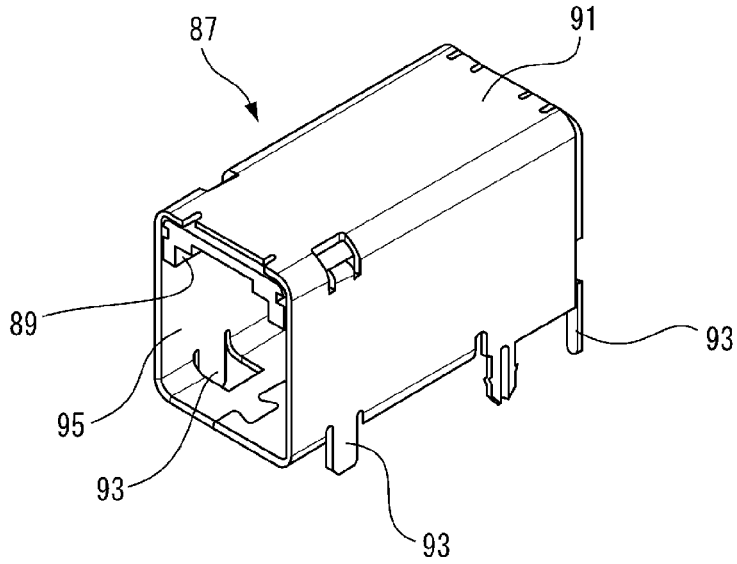
FIG. 8A is a perspective view of a mating connector.
Figure 8B:
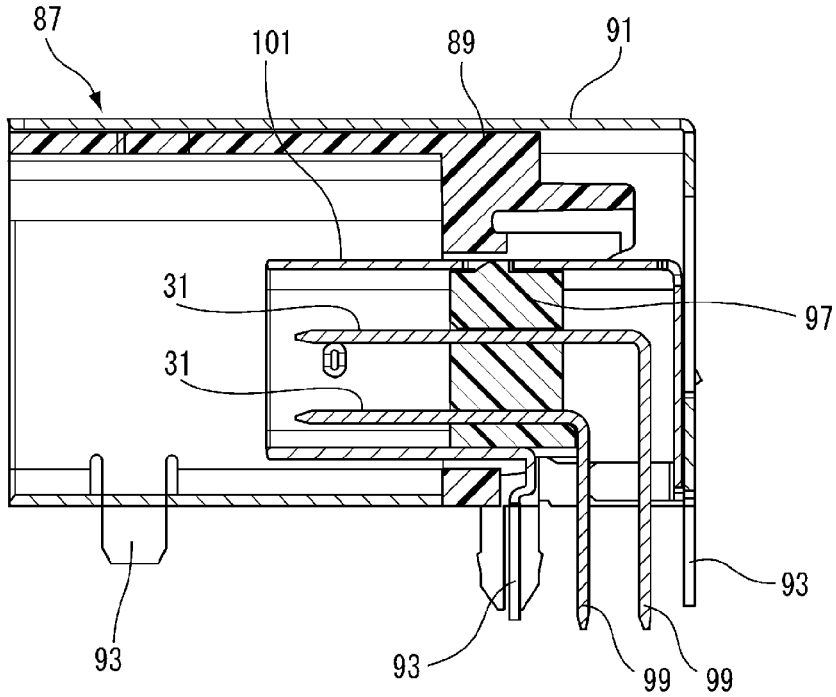
FIG. 8B is a sectional view of the mating connector shown in FIG. 8A.

In a mating connector 87 shown in FIGS. 8A and 8B, the outside of a mating outer housing 89 is covered by an outer shield shell 91. Board connecting parts 93 are vertically provided at the outer shield shell 91, and the board connecting parts 93 are soldered to through holes which are formed on a board of an electronic device not shown in the figure and connected to the ground of the board at the same time. A connector fitting space 95 for receiving the shielded connector 11 is formed inside the mating outer housing 89. A mating inner housing 97 is provided in the connector fitting space 95, and the mating inner housing 97 accommodates the tabs 31 which are a plurality of mating male terminals. The tabs 31 are connected to a predetermined circuit when lead parts 99 of the tabs 31 are soldered to through holes of the board not shown in the figure. The tabs 31 will be connected to the terminals 13 of the shielded connector 11. The mating inner housing 97 is covered by a mating inner shell 101. Board connecting parts 93 are vertically provided at the mating inner shell 101, and the board connecting parts 93 are soldered to through holes which are formed on the board not shown in the figure and connected to the ground of the board at the same time.

The shield shell cover 21 which covers the shielded wire exposure part 86 of the shielded electric wire 37 which is attached into the shield shell 19, as shown in FIG. 5, has a pair of insertion lap parts 22 which are inserted between two side surfaces 18 of the inner housing 15 and two side surfaces 72 of the shield part 77. A backlash preventing unit which prevents a shake is provided by engaging the housing top surface 80 and the housing bottom surface 90 of the inner housing 15 with the shield part 77 opposite to the housing top surface 80 and housing bottom surface 90.

Figure 3:
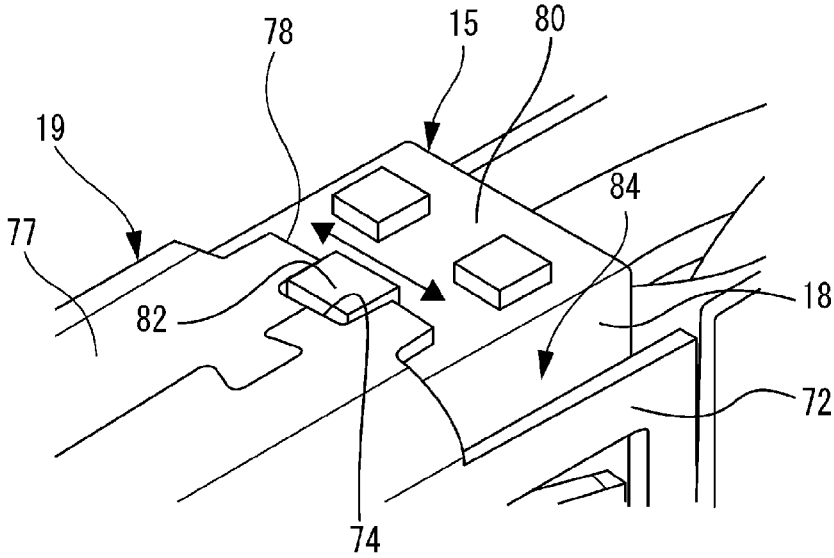
FIG. 3 is an enlarged view of main parts which indicates the engagement of a lock projection on the housing top surface shown in FIG. 2 with a retaining recess which is formed at the back edge of the shield shell.
Figure 4:
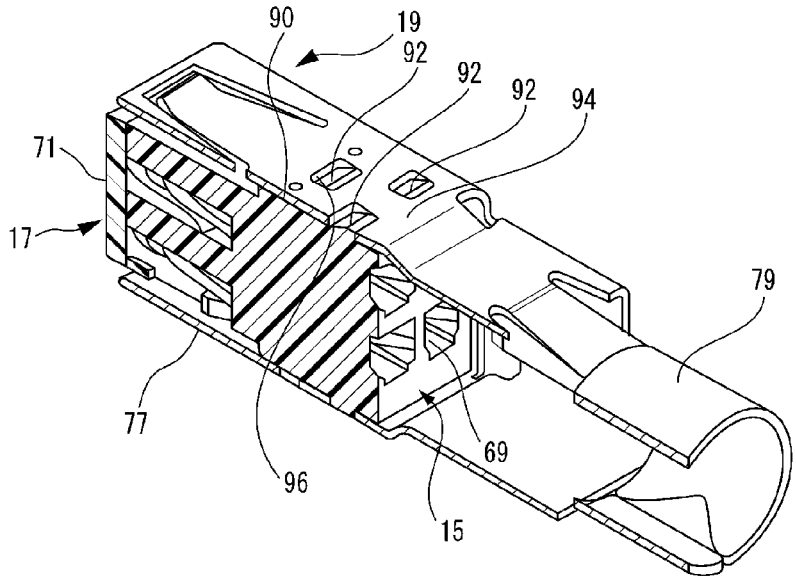
FIG. 4 is a sectional perspective view of the shield shell to which an inner housing is attached when viewed from below.

The backlash preventing unit according to the present embodiment, as shown in FIGS. 3 and 4, includes a retaining projection 82 which is projected on the housing top surface 80 of the inner housing 15, a retaining recess 74 which is formed at the upper back edge (back edge) 78 of the shield part 77 and clamps the retaining projection 82 in the widthwise direction, a plurality of (in the illustrated example, three) position regulation locking parts 92 which are projected on the housing bottom surface 90, and a plurality of position regulation holes 96 which are formed in the shell bottom surface 94 of the shield shell 19 and locks the position regulation locking parts 92.

Thereby, the inner housing 15 is positioned and held at the shield shell 19 on the top and the bottom surfaces, and a shake can be avoided definitely. It is needless to say that not only the structure of the present embodiment but also various kinds of forms can be adopted as the backlash prevention mechanism, based on the purpose of the present disclosure.

Next, an assembling procedure of the shielded connector 11 having the above structure and the effects of the shielded connector 11 are described.

To assemble the shielded connector 11, as shown in FIG. 1, the terminals 13 are crimped and connected to the ends of the plurality of shielded wires of the shielded electric wire 37 to form the terminal installing shielded electric wire 39. The terminals 13 of the terminal installing shielded electric wire 39 are inserted into the terminal accommodating chambers 49 of the inner housing 15, respectively.

Figure 2:
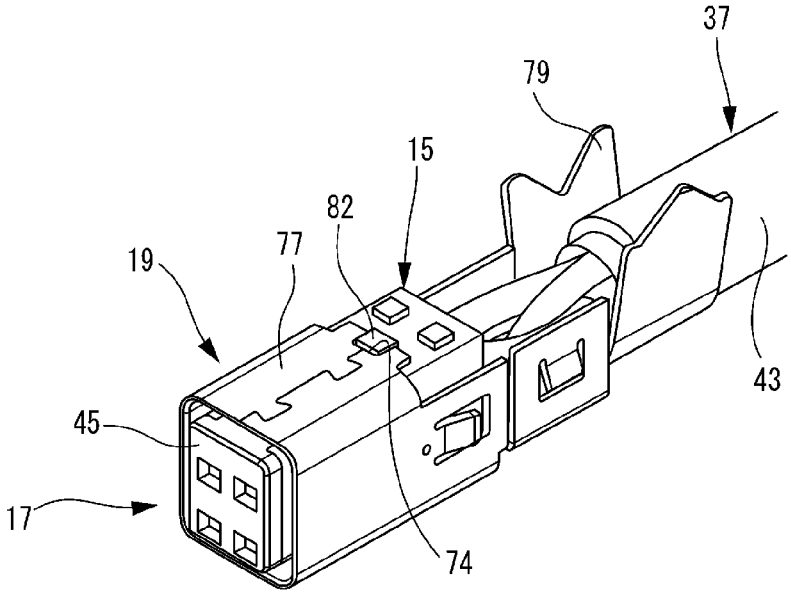
FIG. 2 is a perspective view of a shield shell to which an inner housing is attached before a barrel part is caulked.

Then, the front folder 17 is assembled to the inner housing 15 from front. As shown in FIG. 2, the inner housing 15 to which the front folder 17 is attached is installed into the shield part 77 of the shield shell 19. The internal height of the shield shell 19, as shown in H of FIG. 7, becomes approximately the same as the overall height of the inner housing 15. Thereby, the inner housing 15 will not produce a shake inside the shield shell 19 in the up and down direction.

The sheath part 43 of the shielded electric wire 37, which is derived from the rear of the inner housing 15 which is attached by being inserted into the shield shell 19, is crimped and fixed with the barrel part 79 of the shield shell 19.

In this case, as shown in FIG. 3, the retaining projection 82 which is formed on the housing top surface 80 of the inner housing 15 is engaged with the retaining recess 74 which is formed at the upper back edge 78 of the shield part 77, and the inner housing 15 is fixed so that a shake in the widthwise direction (direction of the arrow in FIG. 3) is regulated. At the same time, the position regulation locking parts 92 of the housing bottom surface 90 (refer to FIG. 4) also lock the position regulation holes 96 of the shell bottom surface 94, and a shake is regulated.

Thus, because the operation of caulking the sheath part 43 in the barrel part 79 is performed when the inner housing 15 is definitely fixed, a highly precise caulking becomes possible.

The shielded wire exposure part 86, as shown in FIG. 5, is covered when the shield shell cover 21 is installed.

The shield shell cover 21 is installed by inserting the insertion lap parts 22 at two sides into gaps 84 which are formed between the two side surfaces 18 of the inner housing 15 and the two side surfaces 72 of the shield shell 19. That is, as shown in FIG. 6, the insertion lap parts 22 of the shield shell cover 21 will not stick out to the outside of the shield shell 19. In this state, the shield shell 19 is attached by being inserted into the outer housing 23. Finally, when the rear folder 25 is locked to the outer housing 23 which accommodates the inner housing 15, the assembling of the shielded connector 11 is completed.

As described above, in order to downsize the shielded connector 11 of the embodiment, the inner housing 15 is formed to be smaller than the shield shell 19 to a degree that the insertion lap parts 22 of the shield shell cover 21 can be inserted to the outside of the two side surfaces 18.

Thus, when the sheath part 43 is caulked to the barrel part 79 of the shield shell 19 to which the inner housing 15 is installed, the gaps 84, which have a thickness of the boards of the insertion lap parts 22, are formed between the inner housing 15 and the shield shell 19. However, when the retaining projection 82 and the position regulation locking parts 92 of the inner housing 15 lock with the retaining recess 74 and position regulation holes 96 of the shield shell 19, the inner housing 15 will not produce a shake inside the shield shell 19 in the widthwise direction. Thereby, a highly precise caulking becomes possible.

Therefore, according to the shielded connector 11 of the present embodiment, when the shielded electric wire 37 is caulked to the barrel part 79 of the shield shell 19, a shake of the installed inner housing 15 inside the shield shell 19 can be controlled. Thus, the inner housing 15 can be smaller than the shield shell 19 and the shielded connector 11 can be downsized.

The shielded connector of the invention is not restricted to the above-described embodiment, and suitable modifications, improvements and the like can be made. Moreover, the materials, shapes, dimensions, numbers, installation places, and the like of the components in the above embodiments are arbitrarily set as far as the invention can be attained, and not particularly restricted.

The present application is based on Japanese Patent Application No. 2011-158290 filed on Jul. 19, 2011, the contents of which are incorporated herein by reference.

What is claimed is:

1. A shielded connector comprising:

an inner housing configured to receive attachment of terminals connected to a shielded electric wire, the inner housing including a first side surface and a second side surface;

a shield shell including a shield part configured to cover the inner housing and a barrel part configured to fix a sheath part of the shielded electric wire, the shield part including a first side surface configured to oppose the first side surface of the inner housing and a second side surface configured to oppose the second side surface of the inner housing; and a shield shell cover configured to cover a shielded wire exposure part of the shielded electric wire fixed to the shield shell, and including a first insertion lap part and a second insertion lap part, the inner housing, the shield shell and the shield shell cover configured to be assembled together, wherein, when the inner housing, the shield shell and the shield shell cover are assembled, the first insertion lap part is disposed between the first side surface of the inner housing and the first side surface of the shield part in a first direction orthogonal to the first side surface of the shield part, and the second insertion lap part is disposed between the second side surface of the inner housing and the second side surface of the shield part in a second direction orthogonal to the second side surface of the shield part, wherein a backlash preventing unit is formed by a first part disposed on a top surface of the inner housing, a second part disposed on a bottom surface of the inner housing, a third part disposed on a portion of the shield part opposite to the top surface of the inner housing and a fourth part disposed on a portion of the shield part opposite to the bottom surface of the inner housing, the backlash preventing unit configured to prevent a shaking between the inner housing and the shield shell, and wherein the first part of the backlash preventing unit includes a retaining projection provided on the top surface of the inner housing, and wherein the third part includes a retaining recess formed at an edge of the shield part and configured to hold the retaining projection in the widthwise direction of the retaining recess.

2. The shielded connector according to claim 1, wherein the second part of the backlash preventing unit includes a projection formed on a bottom surface of the inner housing and the fourth part of the backlash preventing unit includes an opening formed in the portion of the shield part opposite to the bottom surface of the inner housing, the opening configured to receive the projection.

* * * * *